US008232783B2

(12) United States Patent
Yanagawa

(10) Patent No.: US 8,232,783 B2
(45) Date of Patent: Jul. 31, 2012

(54) CONSTANT-VOLTAGE POWER SUPPLY CIRCUIT

(75) Inventor: Kenji Yanagawa, Miyazaki (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 474 days.

(21) Appl. No.: 12/556,068

(22) Filed: Sep. 9, 2009

(65) Prior Publication Data

US 2010/0079121 A1 Apr. 1, 2010

(30) Foreign Application Priority Data

Sep. 26, 2008 (JP) ..... 2008-248062

(51) Int. Cl.
*G05F 1/573* (2006.01)

(52) U.S. Cl. ..... 323/277; 323/280

(58) Field of Classification Search ..... 323/273, 323/275, 277, 279, 280
See application file for complete search history.

(56) References Cited

U.S. PATENT DOCUMENTS 6,600,299 B2 * 7/2003 Xi ..... 323/280
2002/0130646 A1 * 9/2002 Zadeh et al. ..... 323/275
2009/0058392 A1 * 3/2009 Yanagawa ..... 323/314
2010/0079121 A1 * 4/2010 Yanagawa ..... 323/277

FOREIGN PATENT DOCUMENTS

JP 03-158912 7/1991
JP 2007-233657 9/2007
JP 2010-079653 4/2010

* cited by examiner

*Primary Examiner* — Jeffrey Sterrett
(74) *Attorney, Agent, or Firm* — Taft Stettinius & Hollister LLP

(57) ABSTRACT

A constant-voltage power supply circuit which limits the consumption current inside at startup or when overloaded and suppresses the occurrence of an overshoot at startup, comprises an error amplifying part; an output part having an outputting PMOS; a load current monitoring part that monitors a load current flowing through the PMOS and increases the bias current of the error amplifying part according to the load current; and a gain adjusting part having a current limiting resistor and that monitors the load current and decreases a gain of the error amplifying part according to this load current. Hence, at startup or when overloaded, the gain adjusting part operates as a limiter circuit. Hence, at startup or when overloaded, the consumption current inside can be limited. Further, at startup, the response is made slower by this limiter operation, thus suppressing the occurrence of an overshoot.

6 Claims, 5 Drawing Sheets

PRIOR ART

PRIOR ART

CONSTANT-VOLTAGE POWER SUPPLY CIRCUIT

CROSS-REFERENCE TO RELATED APPLICATIONS

This application claims priority under 35 U.S.C. §119 from Japanese Patent Application No. 2008-248062 filed on Sep. 26, 2008, the disclosure of which is incorporated by reference herein.

RELATED ART

1. Field of the Invention

The present disclosure relates to a constant-voltage power supply circuit incorporated in semiconductor integrated circuits and the like.

2. Description of the Related Art

FIG. 1 is a circuit diagram showing a conventional constant-voltage power supply circuit.

This constant-voltage power supply circuit comprises an error amplifying part 10 that amplifies the difference between a reference voltage Vref and a voltage Vfb proportional to an output voltage Vout outputted from an output terminal 30, and an output part 20 connected to the output side of the error amplifying part 10 and controlled by the output of the error amplifying part 10 to control the output voltage Vout outputted from the output terminal 30 to be constant.

The error amplifying part 10 is constituted by a differential amplifier having P-channel MOS transistors (hereinafter called "PMOS") 11, 12 as loads connected to a power supply voltage VCC node; N-channel MOS transistors (hereinafter called "NMOS") 13, 14 serially connected respectively to the PMOSs 11, 12 and that are input transistors to which the reference voltage Vref and the voltage Vfb are respectively inputted to be amplified differentially; and an NMOS 15 for a constant current source making a constant current according to a bias voltage Vb flow that is connected between the NMOSs 13, 14 and ground GND. The output part 20 has a PMOS 21 as an output transistor and voltage-dividing resistors 22, 23, which are serially connected between a power supply voltage VCC node and ground GND. The connection point of the PMOS 21 and the voltage-dividing resistor 22 is connected to the output terminal 30 outputting the output voltage Vout.

Generally, in order to suppress steep output voltage variations due to load current variations, a capacitor 31 having a capacitance value of, e.g., about several μF is connected externally to use the circuit.

FIG. 2 shows a frequency characteristic of the constant-voltage power supply circuit of FIG. 1.

In the case of the circuit configuration of FIG. 1 with the capacitor 31 connected externally, in frequency characteristics of the error amplifying part 10 and of the output part 20 of the constant-voltage power supply circuit, the pole of the output part 20 may exist in a lower frequency range than the pole of the error amplifying part 10 as shown in FIG. 2. If there are two poles, the two poles being close to each other in frequency will result in not enough phase margin, which may cause the oscillation of the output voltage Vout. Hence, the two poles need to be separated by enough distance.

If the pole of the output part 20 exists in a lower frequency range as shown in FIG. 2, the pole of the output part 20 will move toward the higher frequency side according to the magnitude of the load current flowing through the PMOS 21. Hence, in order to make the constant-voltage power supply circuit having this pole position relationship operate stably, the pole of the error amplifying part 10 needs to be placed on the high enough frequency side to secure enough phase margin even if the pole of the output part 20 changes due to a load current variation. Accordingly, a measure such as increasing the bias current of the error amplifying part 10 needs to be taken. However, in applications which need a large load current driving capability, the distance by which the pole of the output part 20 moves toward the higher frequency side is greater. Hence, using only the measure of increasing the bias current of the error amplifying part 10 will cause an excessive current to be consumed, having its limitation.

Accordingly, for the stability of the output voltage Vout and the prevention of an excessive current at the operation start of the constant-voltage power supply circuit of FIG. 1, the measure of providing a feedback circuit as disclosed in Japanese Patent Kokai No. 2007-233657 is possible to be taken.

Further, in order to secure a greater phase margin, the measure of providing a load current monitoring part as disclosed in Japanese Patent Kokai No. H03-158912 is possible to be taken.

FIG. 3 is a circuit diagram showing another conventional constant-voltage power supply circuit described in Japanese Patent Kokai No. H03-158912.

This constant-voltage power supply circuit is the circuit of FIG. 1 having a load current monitoring part 40 added thereto. The load current monitoring part 40 is a circuit that feeds back a bias current proportional to the output current of the output terminal 30 to the error amplifying part 10, thereby realizing high speed response and low consumption current, and is constituted by a PMOS 41 and NMOSs 42, 43.

FIG. 4 shows a frequency characteristic of the constant-voltage power supply circuit of FIG. 3 for when the load current is large.

By adding the load current monitoring part 40 shown in FIG. 3, if the pole of the output part 20 is lower in frequency than the pole of the error amplifying part 10 as mentioned above, the bias current of the error amplifying part 10 can be increased as the load current flowing through the PMOS 21 increases. Thus, as shown in FIG. 4, the pole of the error amplifying part 10 can be moved toward the higher frequency side according to the load current.

Because the pole of the output part 20 and the pole of the error amplifying part 10 both move according to the load current, if designing the position relationship between the pole of the output part 20 and the pole of the error amplifying part 10 so as to secure an enough phase margin over the entire load current range, then by changing the consumption current in the circuit according to the magnitude of the load current, lowering the power consumption can be achieved and in addition the circuit can be made to operate stably.

INTRODUCTION TO THE INVENTION

However, the conventional constant-voltage power supply circuit of FIG. 3 has the following problem.

FIG. 5 shows a frequency characteristic of the constant-voltage power supply circuit of FIG. 3 for when the load current is small.

In the load current monitoring part 40 of FIG. 3, where the load current flowing through the PMOS 21 is small, the amounts of variation in the gate-to-source voltages Vgs of the PMOS 21 and the PMOS 41 monitoring the gate voltage are small, and hence the bias current of the error amplifying part 10 provided by the load current monitoring part 40 hardly increases.

Hence, where the load current is small, as shown in FIG. 5, compared with the amount of movement of the pole of the output part 20 associated with an increase in its load current, the pole of the error amplifying part 10 hardly moves, and thus the two poles approach each other, reducing the phase margin. In this case, by enlarging the gate width of the PMOS 41, the amount by which the bias current in the error amplifying part 10 increases according to the load current can be increased, thus increasing the amount of movement of the pole of the error amplifying part 10. However, when enlarging the gate width of the PMOS 41, not only the circuit area is enlarged, but also the consumption current in the load current monitoring part 40 increases, thus increasing the consumption current of the entire circuit. Hence, this is not a good measure to be taken.

As such, adding the load current monitoring part 40 has the advantages of high speed response and low consumption current, but has the disadvantage that the phase margin is reduced where the load current is small and in addition the problems that the overshoot amount of the output voltage Vout may be larger at startup and that the current consumption in the load current monitoring part itself will increase if the output voltage Vout is clamped by an over load.

A constant-voltage power supply circuit of the present disclosure comprises an error amplifying part in which a bias current flows due to a bias voltage and that amplifies the difference between a reference voltage and a first voltage corresponding to an output voltage outputted from an output terminal; an output transistor connected between the output terminal and a power supply node and controlled by an output of the error amplifying part to control the output voltage to be constant; a load current monitoring part that monitors a load current flowing through the output transistor and increases the bias current according to the load current; a gain adjusting part that monitors the load current and decreases a gain of the error amplifying part according to the load current; and a current limiting resistor provided in the load current monitoring part and that limits a consumption current of the load current monitoring part or the bias current at startup or when overloaded.

According to the present disclosure, at startup or when overloaded, the gain adjusting part operates as a limiter circuit. Hence, at startup or when overloaded, the consumption current inside can be limited. Further, at startup, the response is made slower by this limiter operation, thus suppressing the occurrence of an overshoot.

DETAILED DESCRIPTION OF THE EXEMPLARY EMBODIMENTS

The exemplary embodiments of the present disclosure are described and illustrated below to encompass constant-voltage power supply circuit incorporated in semiconductor integrated circuits and the like. Of course, it will be apparent to those of ordinary skill in the art that the embodiments discussed below are exemplary in nature and may be reconfigured without departing from the scope and spirit of the present invention. However, for clarity and precision, the exemplary embodiments as discussed below may include optional steps, methods, and features that one of ordinary skill should recognize as not being a requisite to fall within the scope of the present disclosure. It should be noted that the drawings are solely for description and are not to limit the technical scope of the present invention.

Embodiment 1

(Configuration of Embodiment 1)

Figure 1:
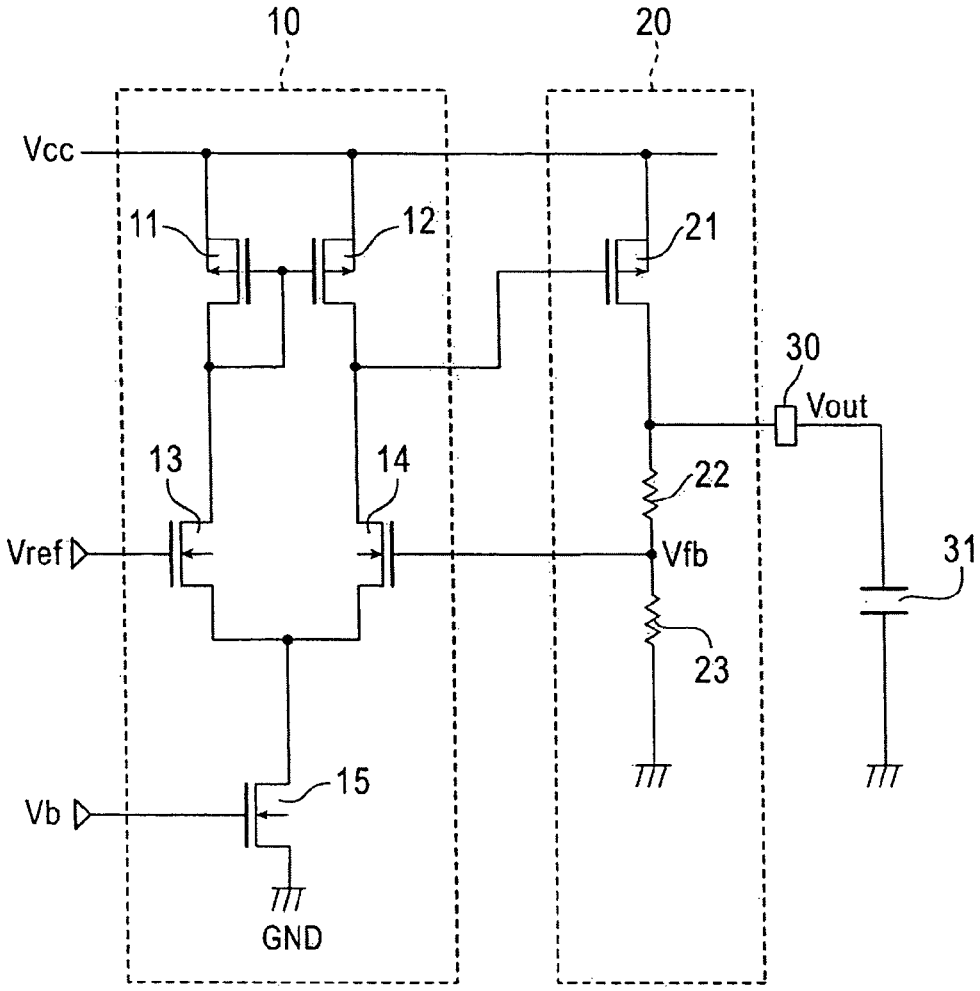
FIG. 1 is a circuit diagram showing a conventional constant-voltage power supply circuit.
Figure 2:
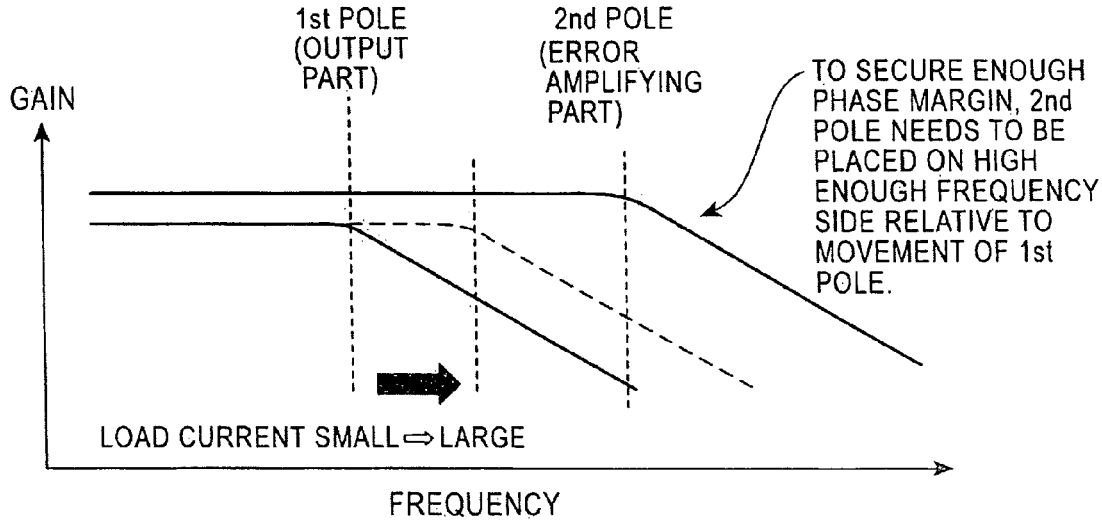
FIG. 2 shows a frequency characteristic of the constant-voltage power supply circuit of FIG. 1.
Figure 3:
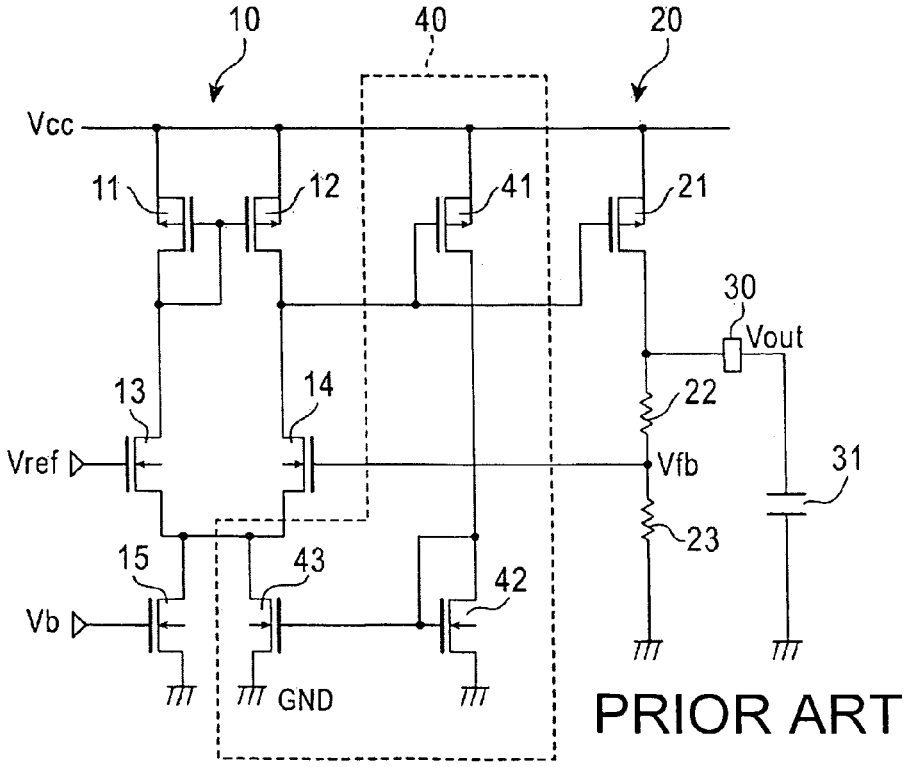
PRIOR ART FIG. 3
FIG. 3 is a circuit diagram showing another conventional constant-voltage power supply circuit.
Figure 4:
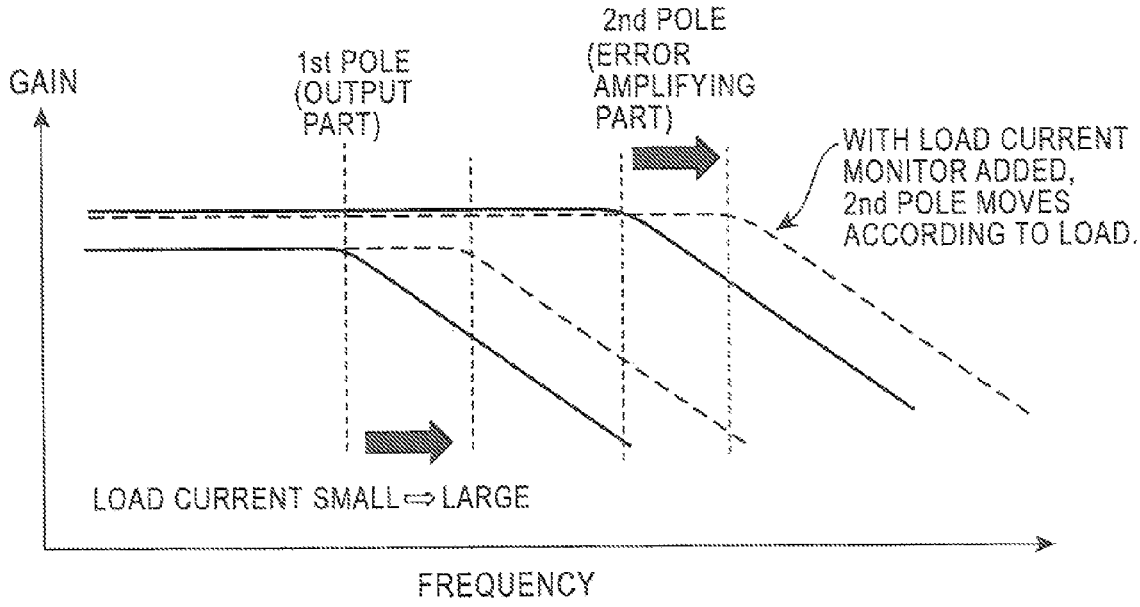
FIG. 4 shows a frequency characteristic of the constant-voltage power supply circuit of FIG. 3 for when the load current is large.
Figure 5:
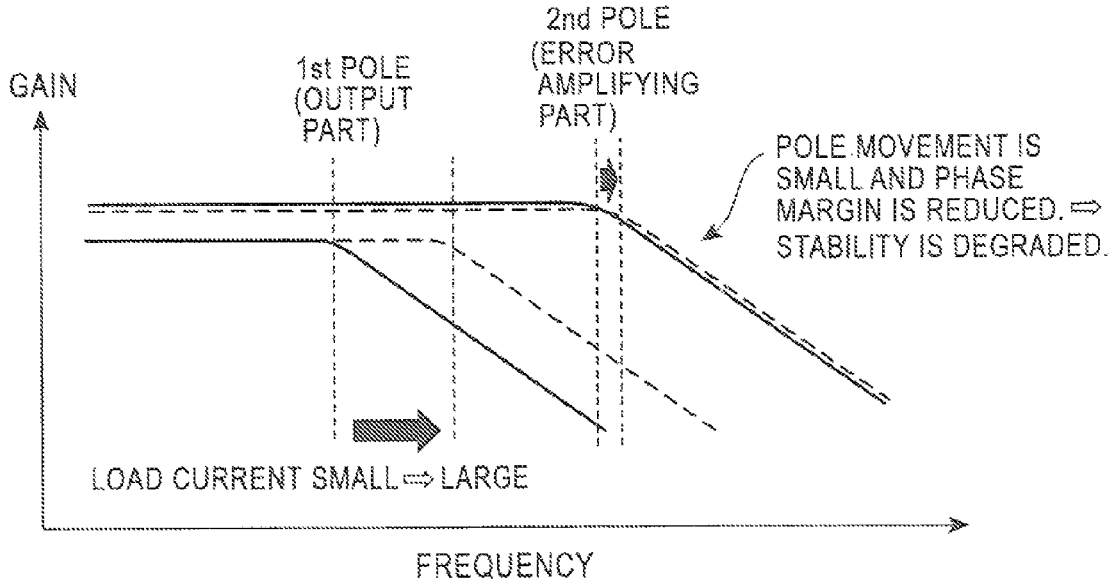
FIG. 5 shows a frequency characteristic of the constant-voltage power supply circuit of FIG. 3 for when the load current is small.
Figure 6:
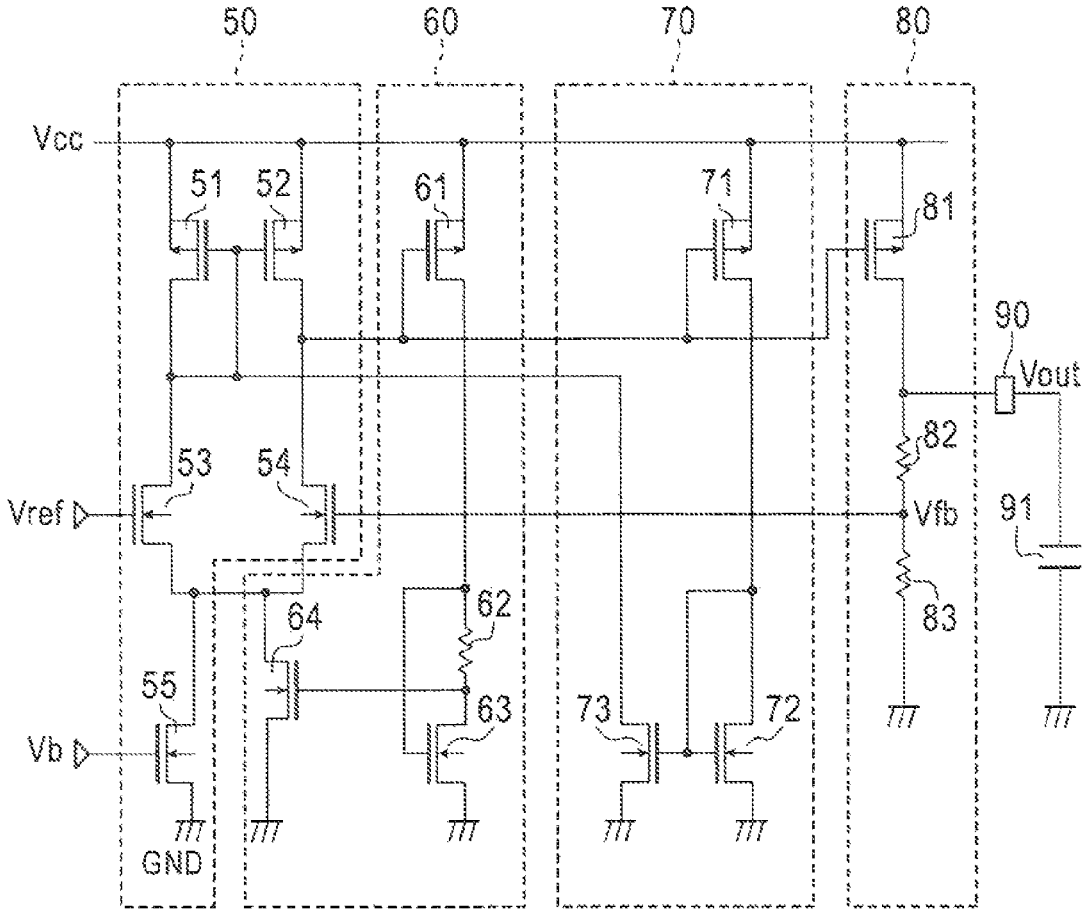
FIG. 6 is a circuit diagram showing a constant-voltage power supply circuit of Embodiment 1 of the present disclosure.

FIG. 6 is a circuit diagram showing a constant-voltage power supply circuit of Embodiment 1 of the present disclosure.

This constant-voltage power supply circuit is incorporated in, e.g., semiconductor integrated circuits and has an error amplifying part 50 that is the same as in the conventional art, and to the output side of the error amplifying part 50 are cascade-connected a load current monitoring part 60 that is different in configuration than in the conventional art, a newly added gain adjusting part 70, and an output part 80 that is the same as in the conventional art. Further, an output terminal 90 outputting an output voltage Vout is connected to the output side of the output part 80.

The error amplifying part 50 is a circuit that, with an externally generated bias voltage Vb causing a bias current to flow, amplifies the difference between an externally generated reference voltage Vref and a first voltage (e.g., a feedback voltage) Vfb corresponding to the output voltage Vout, and comprises load transistors (e.g., PMOSs) 51, 52, first and second input transistors (e.g., NMOSs) 53, 54, and a first transistor (e.g., NMOS) 55 for a constant-current source through which the bias current flows.

Each of the PMOSs 51, 52 is connected at its source terminal (hereinafter simply called a "source") to a power supply voltage VCC node, and their gate terminals (hereinafter simply called "gates") are connected to each other. The drain terminals (hereinafter simply called "drains") of the PMOSs 51, 52 are connected to the drains of the NMOSs 53, 54 respectively. The reference voltage Vref is applied to the gate of the NMOS 53. The feedback voltage Vfb corresponding to the output voltage Vout is applied to the gate of the NMOS 54. The sources of the NMOSs 53, 54 are connected to each other, and this connection point connects to the drain of the NMOS 55. The source of the NMOS 55 is connected to ground GND, and the externally generated bias voltage Vb is applied to its gate.

The load current monitoring part 60 is a circuit that monitors the load current flowing through the output part 80, increasing the bias current of the error amplifying part 50 according to this load current, and comprises a third transistor (e.g., PMOS) 61 for load-current monitoring, a current limiting resistor 62 (e.g., a line resistance element of poly-silicon embedded in an interlayer insulating film on a silicon substrate), a fourth transistor (e.g., NMOS) 63, and a second transistor (e.g., NMOS) 64 for bias-current adjustment.

The PMOS 61 is connected at its source to a power supply voltage VCC node, and its gate is connected to the drain of the PMOS 52. The drain of the PMOS 61 is connected to the drain of the NMOS 63 via a resistor 62 and also to the gate of the NMOS 63. The source of this NMOS 63 is connected to ground GND. The drain of the NMOS 63 is connected to the gate of the NMOS 64, and the drain of the NMOS 64 is connected in common to the sources of the NMOSs 53, 54. Further, the source of the NMOS 64 is connected to ground GND. The NMOSs 63, 64 form a current mirror circuit.

The gain adjusting part 70 is a circuit that monitors the load current flowing through the output part 80 and that decreases the gain of the error amplifying part 50 according to this load current, and comprises a load-current monitoring PMOS 71 and a current mirror circuit formed by NMOSs 72, 73.

The PMOS 71 is connected at its source to a power supply voltage VCC node, and its gate is connected to the gate of the PMOS 61. The drain of the PMOS 71 is connected to the drain and gate of the NMOS 72 and to the gate of the NMOS 73. The sources of the NMOSs 72, 73 are connected to ground GND. The drain of the NMOS 73 is connected to the drain and gate of the PMOS 51 and to the gate of the PMOS 52.

The output part 80 comprises an output transistor (e.g., load-current flowing PMOS) 81 controlled by the output voltage of the error amplifying part 50 to control the output voltage Vout to be constant and voltage dividing resistors 82, 83 that divide the output voltage Vout to produce the feedback voltage Vfb.

The PMOS 81 is connected at its source to a power supply voltage VCC node, and its gate is connected to the drain of the PMOS 52 and to the gates of the PMOSs 61, 71. The voltage dividing resistors 82, 83 are connected serially between the drain of the PMOS 81 and ground GND. The output terminal 90 is connected to the connection point of the PMOS 81 and the voltage dividing resistor 82. For example, a stabilizing capacitor 91 is connected to the output terminal 90.

Figure 7:
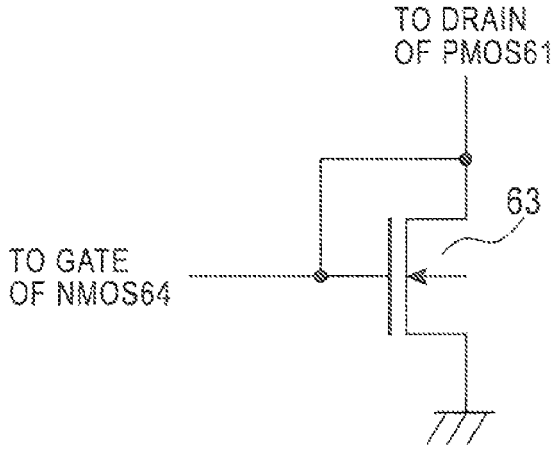
FIG. 7 is another circuit diagram of the NMOS 63 part in FIG. 6.
Figure 8:
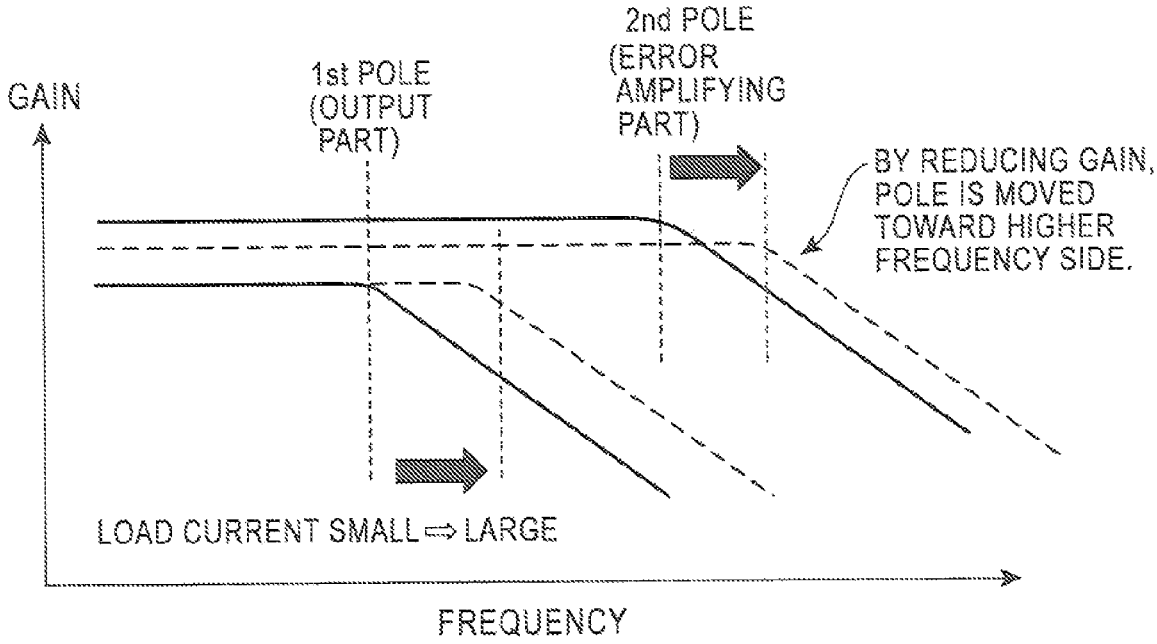
FIG. 8 shows a frequency characteristic of a constant-voltage power supply circuit having the circuit of FIG. 7 for when the load current is small.

FIG. 7 is another circuit diagram of the NMOS 63 part in FIG. 6. FIG. 8 shows a frequency characteristic of a constant-voltage power supply circuit having the circuit of FIG. 7 for when the load current is small.

The constant-voltage power supply circuit of the present embodiment 1 is based on the circuit configuration with the resistor 62 being not contained in the NMOS 63 part in the load current monitoring part 60, as shown in FIG. 7. Accordingly, first the operation 1 of the constant-voltage power supply circuit without the resistor 62 will be described with reference to FIG. 8, and then the operation 2 of the constant-voltage power supply circuit of FIG. 6 with the resistor 62 added will be described.

(Operation 1 of Embodiment 1)

When the power supply voltage VCC, the reference voltage Vref, and the bias voltage Vb are applied, the error amplifying part 50 amplifies the difference between the reference voltage Vref and the feedback voltage Vfb into which the output voltage Vout is divided by the resistors 82, 83 to produce the gate voltage for the outputting PMOS 81. The outputting PMOS 81 is controlled by this gate voltage to control the output voltage Vout to be constant.

The PMOS 61 of the load current monitoring part 60 copies the drain current flowing through the outputting PMOS 81 in a certain ratio (e.g., 1:1000, etc.) and supplies the copied current to the NMOS 63. The NMOSs 63, 64 form a current mirror circuit, and the current supplied to the NMOS 63 is copied in the NMOS 64, and the copied current forms a bias current of the error amplifying part 50. In the load current monitoring part 60, as the drain current (load current) of the outputting PMOS 81 increases, with the PMOS 61 copying it, the bias current of the error amplifying part 50 is increased via the current mirror circuit of the NMOSs 63, 64. By this means, the response of the output voltage Vout is made faster, and in addition the pole of the error amplifying part 50 is moved toward the higher frequency side.

In the gain adjusting part 70, the PMOS 71 copies the drain current of the outputting PMOS 81 as does the PMOS 61 of the load current monitoring part 60 and supplies the copied current to the NMOS 72. As to the gate width/gate length (W/L) ratios of the PMOSs 61, 71, the ratio of the PMOS 61 is set larger than that of the PMOS 71 so that the drain current of the PMOS 61>the drain current of the PMOS 71, with respect to the drain current of the PMOS 81.

The NMOSs 72, 73 form a current mirror circuit, and the NMOS 73 copies the current supplied to the NMOS 72 to sink a part, equal in amount to the monitored current, of the drain current of the PMOS 51 of the error amplifying part 50.

In the error amplifying part 50, if the reference voltage Vref and the feedback voltage Vfb into which the output voltage Vout is divided by the resistors 82, 83 are equal, the drain currents of the NMOSs 53, 54 forming the differential stage of the error amplifying part 50 are equal, and this drain current is half of the sum of the drain currents of the NMOSs 55, 64. As in the conventional art, without the gain adjusting part 70, the drain current of the NMOS 53 and PMOS 51 and the drain current of the NMOS 54 and PMOS 52 would be equal and balanced. With the gain adjusting part 70 connected as in the present embodiment 1, the drain current of the PMOS 51 is the sum of the drain currents of the NMOSs 53, 73, and the drain current of the PMOS 51 increases by the amount of the drain current of the NMOS 73 as compared with the circuit without the gain adjusting part 70. By this means, the output impedance of the error amplifying part 50 decreases, and as shown in FIG. 8, the gain of the error amplifying part 50 is reduced, and in addition the pole of the error amplifying part 50 is moved toward the higher frequency side.

If configured with only the load current monitoring part 60 as in the conventional art, when the load current is small, the bias current of the error amplifying part 50 hardly increases. Hence, the pole of the error amplifying part 50 hardly moves relative to the movement amount of the pole of the output part 80, and thus there is the problem that the phase margin is reduced in a certain load current range. In contrast, by adding the gain adjusting part 70 as in the present embodiment 1, the pole of the error amplifying part 50 can be moved toward the higher frequency side, thus preventing the reduction in phase margin.

Generally, the bias current of the error amplifying part 50 (the drain current of the NMOS 55) is made as small as possible to suppress the consumption current. When the load current is small, the bias current provided by the load current monitoring part 60 (the drain current of the NMOS 64) is also small, and hence the sink current by the NMOS 73 of the gain adjusting part 70 is small, but because the ratio of the sink current by the NMOS 73 to the bias current of the error amplifying part 50 is larger, the pole movement due to the gain adjusting part 70 shows itself larger when the load current is small.

In contrast, when the load current is large, the sink current by the NMOS 73 of the gain adjusting part 70 is large, but because the rate of increase in the bias current provided by the load current monitoring part 60 is larger, the pole movement due to the load current monitoring part 60 shows itself larger.

As to the high speed response that is a feature of the original load current monitoring part 60, if the load current greatly changes, because the increase in the bias current of the error amplifying part 50 by the load current monitoring part 60 is large, that feature remains as it is with the circuit of FIG. 7. Further, because the gain adjusting part 70 is configured to adjust the sink current according to the load current as does the load current monitoring part 60, the consumption current inside can be made sufficiently small even with the gain adjusting part 70 added.

As described above, in the constant-voltage power supply circuit of FIG. 6 with the circuit configuration without the resistor 62, as shown in FIG. 7, by adding the gain adjusting part 70, the problem that the stability is degraded when the load current is small can be improved with keeping the features of high speed response and low consumption current that the load current monitoring part 60 originally has.

However, while the load current monitoring part 60 has the advantages of high speed response and low consumption current, there remains the disadvantage that the phase margin is reduced where the load current is small and in addition the problems that the overshoot amount of the output voltage may be larger at startup and that the current consumption in the load current monitoring part 60 itself will increase if the output voltage Vout is clamped by an over load or the like as mentioned above.

Accordingly, in order to improve the problems, in the present embodiment 1, the current-limiting resistor 62 is provided in the load current monitoring part 60 as shown in FIG. 6. The operation 2 of this will be described below.

(Operation 2 of Embodiment 1)

In the constant-voltage power supply circuit of FIG. 6, at startup or when overloaded, a large current flows through the outputting PMOS 81, and hence the drain current of the PMOS 61 of the load current monitoring part 60 copying the drain current of the PMOS 81 is also large. However, with the resistor 62 inserted, when the drain current of the PMOS 61 becomes equal to or greater than a certain current value, the source-to-drain voltage of the NMOS 63 is lowered due to the voltage drop across the resistor 62. Because along with this the gate voltage of the NMOS 64 is lowered, its drain current decreases, and the bias current of the error amplifying part 50 decreases.

Meanwhile, in the gain adjusting part 70, at startup or when overloaded, the drain current of the PMOS 71 and NMOS 72 is large, and the sink current by the NMOS 73 is large. The bias current provided by the load current monitoring part 60 decreases with the sink current by the gain adjusting part 70 increasing, and thus it starts that only the gain adjusting part 70 functions, and the gate voltage of the outputting PMOS 81 is held at a constant level due to the feedback by the gain adjusting part 70. This means that the gain adjusting part 70 operates as a limiter, and in this state, not only the output current provided by the PMOS 81 is limited, but also the consumption current in the gain adjusting part 70 is limited, thus limiting currents consumed at startup and when overloaded.

(Effects of Embodiment 1)

According to the present embodiment 1, by adopting the circuit configuration shown in FIG. 6, the gain adjusting part 70 operates as a limiter both at startup and when overloaded. Hence, both at startup and when overloaded, the consumption current inside can be limited. Further, at startup, the response is made slower by this limiter operation, thus suppressing the occurrence of an overshoot.

(Modified Examples)

The present invention can be used in various forms and modified, not being limited to the above embodiment 1. These use forms and modified examples include, for example, the following (a) to (c):

(a) Although in the embodiment 1 the error amplifying part 50 having a differential stage formed by NMOS transistors is used, the present invention can be applied to circuit configurations of the error amplifying part 50 and an output transistor (PMOS 81), whatever configuration the error amplifying part 50 has;

(b) The place where the resistor 62 of the load current monitoring part 60 is inserted can be other than that place in the circuit diagram of FIG. 6 as long as the resistor limits the consumption current of the load current monitoring part 60 or the bias current of the error amplifying part 50 when overloaded; and (c) Instead of the resistor 62, a MOS transistor or the like can be used as a resistor.

Following from the above description, it should be apparent to those of ordinary skill in the art that while the methods and apparatuses herein described constitute exemplary embodiments of the present disclosure and that changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any or all of the identified advantages or objects of the disclosure in order to fall within the scope of any claims, since the invention is defined by the claims and since inherent and/or unforeseen advantages of the present invention may exist even though they may not have been explicitly discussed herein.

What is claimed is:

1. A constant-voltage power supply circuit comprising:

an error amplifier in which a bias current flows due to a bias voltage, the error amplifier amplifying a difference between a reference voltage and a first voltage corresponding to an output voltage outputted from an output terminal;

an output transistor connected between said output terminal and a power supply node and controlled by an output of said error amplifier to control said output voltage to be constant;

a load current monitor that monitors a load current flowing through said output transistor and increases said bias current responsive to said load current;

a gain adjustor that monitors said load current and decreases a gain of said error amplifier responsive to said load current; and a current limiting resistor provided in said load current monitor and that limits a consumption current of at least one of said load current monitor and said bias current during at least one of startup and when overloaded.

2. A constant-voltage power supply circuit according to claim 1, wherein said error amplifier is constituted by a differential amplifier comprising:

first and second input transistors to which said reference voltage and said first voltage are respectively inputted to be amplified differentially; and a first transistor for a constant-current source that causes said bias current to flow through said first and second input transistors based on said bias voltage.

3. A constant-voltage power supply circuit according to claim 2, wherein said load current monitoring part comprises:

a second transistor for bias-current adjustment connected in parallel with said first transistor;

a third transistor that together with said output transistor forms a current mirror circuit and monitors said load current;

a fourth transistor connected serially to said third transistor and that together with said second transistor forms a current mirror circuit and causes a current corresponding to a current flowing through said third transistor to flow through said second transistor; and said current limiting resistor connected serially to said fourth transistor.

4. A constant-voltage power supply circuit according to claim 1, wherein said first voltage is generated by dividing said output voltage with resistors.

5. A constant-voltage power supply circuit according to claim 1, wherein a stabilizing capacitor is connected to said output terminal.

6. A constant-voltage power supply circuit according to claim 1, wherein said constant-voltage power supply circuit is incorporated in a semiconductor integrated circuit.

* * * * *